United States Patent [19]

Maruta et al.

[11] Patent Number: 4,551,738

[45] **Date of Patent: * Nov. 5, 1985**

[54] THERMOSENSITIVE RECORDING MATERIAL

[75] Inventors: Keiichi Maruta; Yukihiro Yuyama, both of Numazu, Japan

[73] Assignee: Ricoh Company, Ltd., Tokyo, Japan

[ * ] Notice: The portion of the term of this patent subsequent to Apr. 24, 2001 has been disclaimed.

[21] Appl. No.: 581,106

[22] Filed: Feb. 17, 1984

Related U.S. Application Data

[63] Continuation-in-part of Ser. No. 352,605, Feb. 24, 1982, Pat. No. 4,444,819.

[30] Foreign Application Priority Data

Mar. 5, 1981 [JP] Japan ..... 56-31457

[51] Int. Cl.[4] ..... B41M 5/18

[52] U.S. Cl. ..... 346/200; 346/209; 346/226; 428/354; 428/694; 428/913

[58] Field of Search ..... 346/200, 209, 226; 428/40, 327, 336, 354, 514, 522, 694, 900, 913, 914

[56] References Cited

U.S. PATENT DOCUMENTS 4,444,819 4/1984 Maruta et al. ..... 428/327

FOREIGN PATENT DOCUMENTS 0052440 5/1978 Japan ..... 282/27.5

*Primary Examiner*—Bruce H. Hess

*Attorney, Agent, or Firm*—Flynn, Thiel, Boutell & Tanis

[57] ABSTRACT

A thermosensitive recording material is disclosed suitable for use in thermosensitive-recording-type tickets, including magnetic tickets, and thermosensitive-recording-type labels, comprising a support material; a thermosensitive coloring layer formed on the front side of the support material, which thermosensitive coloring layer comprises a leuco dye and an acidic material capable of coloring the leuco dye when heat is applied thereto; and a protective layer formed on the thermosensitive coloring layer, which protective layer comprises a polyvinyl alcohol with a saponification ratio ranging from 70% to 85% and is capable of preventing intrusion of materials which may discolor the thermosensitive coloring layer.

15 Claims, No Drawings

THERMOSENSITIVE RECORDING MATERIAL

CROSS-REFERENCE TO RELATED APPLICATION

This is a continuation-in-part of Ser. No. 352 605, filed Feb. 24, 1982, now Pat. No. 4,444,819.

BACKGROUND OF THE INVENTION

The present invention relates to a thermosensitive recording material and more particularly to a thermosensitive recording material suitable for use as thermosensitive-recording-type tickets, including magnetic tickets, and thermosensitive-recording-type labels.

Conventionally, there is known a thermosensitive recording material comprising a support material and a thermosensitive coloring layer formed thereon, which coloring layer contains a leuco dye and an acidic material. The thermosensitive recording materials of this type are widely used, since they have many advantages over other recording materials, for instance, image formation or printing can be easily done and the images obtained by heat application are clear.

When such conventional thermosensitive recording materials are employed as thermosensitive-recording-type tickets, such as passenger tickets, coupon tickets and commutation tickets, or as label sheets for indicating product names, numbers or prices, etc., if the front surface of the thermosensitive recording material is kept in contact with a plastic film, the images and letters formed on the thermosensitive recording materials lose their color and become illegible due to the action of plasticizers, such as dioctyl phthalate and dioctyl adipate, contained in the plastic film. That the recorded images and letters cannot be made permanent and will be lost if the storage conditions are not appropriate leads to low reliability of the tickets, the label sheets, etc., made of that recording material, and causes various troubles to those who use them. This shortcoming has been a significant hindrance to employment of thermosensitive recording materials as tickets, including magnetic tickets, and label sheets in practice.

SUMMARY OF THE INVENTION

It is therefore an object of the present invention to provide a thermosensitive recording material capable of retaining images formed thereon even if it is continuously in contact with films which contain plasticizers, which thermosensitive recording material comprises (1) a support material, (2) a thermosensitive coloring layer formed thereon, comprising a leuco dye and an acidic material, and (3) a protective layer formed on the thermosensitive coloring layer for protecting the thermosensitive coloring layer, which protective layer comprises a polyvinyl alcohol with a saponification ratio ranging from 70% to 85%. The protective layer is extremely thin and does not hinder the coloring of the thermosensitive recording layer, yet, despite that thinness, the thermosensitive coloring layer is effectively protected from the plasticizers which may come into contact with it.

DETAILED DESCRIPTION OF THE PREFERRED EMBODIMENTS

A thermosensitive recording material according to the present invention comprises (1) a support material, (2) a thermosensitive coloring layer comprising a leuco dye and an acidic material, formed on the support material, and (3) a protective layer for covering and protecting the thermosensitive coloring layer, which protective layer comprises a polyvinyl alcohol resin with a saponification ratio ranging from 70% to 85%, preferably from 75% to 80%.

When the saponification ratio of the polyvinyl alcohol resin exceeds the above-mentioned range, the protection of the thermosensitive coloring layer from plasticizers which may discolor the thermosensitive coloring layer is significantly reduced.

The polyvinyl alcohol for use in the present invention can be used together with ordinarily available water-resisting agents in order to make the thermosensitive recording material water-resistant.

The protective layer serves to prevent plasticizers from penetrating into the thermosensitive coloring layer and thus to protect the thermosensitive coloring layer from the plasticizers when the thermosensitive recording material happens to be brought into close contact with plastic films or other materials which contain plasticizers.

The thickness of the protective layer can be in the range of 0.5 μm to 15 μm, preferably in the range of 1 μm to 8 μm, although this is not critical.

When preparing the protective layer, a variety of auxiliary components can be added to the polyvinyl alcohol. The following auxiliary components, for example, can be added: Thermosetting organic fillers for preventing the protective layer from sticking to a thermal printer head when image formation is done by thermal printers (i.e., the so-called sticking phenomenon); organic antifriction materials for reducing the abrasion of the thermal printer head, which abrasion is caused by the friction between the thermal printer head and the protective layer and which abrasion is increased by the addition of the thermosetting organic fillers to the protective layer; and water resistant agents.

These auxiliary components for the protective layer will now be explained in more detail:

In the present invention, the thermosetting organic fillers are defined as materials which are hardened by application of heat thereto at the time of thermal printing by use of thermal printers.

Examples of the thermosetting organic fillers are urea-formaldehyde resin, phenolic resin, polycarbonate resin and melamine resin.

The thermosetting organic fillers may be added to the protective layer in an amount of 5 to 40 weight percent, preferably 20 to 30 weight percent, with respect to the total weight of the protective layer.

The organic antifriction agents that can be employed in the present invention are organic solid materials with smooth surfaces, including animal waxes such as bees wax and shellac wax; vegetable waxes such as carnauba wax; petroleum waxes such as paraffin wax and microcrystalline wax; and other synthetic waxes such as polyethylene wax, polyhydric alcohol esters of higher fatty acids, higher fatty ketones, higher fatty amines, higher fatty amides, condensates of fatty acids and amines, synthetic paraffins, paraffin chlorides, condensates of aromatic carboxylic acids and high fatty amines, and condensates of aromatic amines and higher fatty acids.

These organic antifriction agents are employed in the form of fine powder or in the form of an emulsion in the protective layer in an amount of 20 to 60 weight percent, preferably 30 to 50 weight percent, with respect to the total weight of the protective layer.

The thermosensitive recording materials according to the present invention can be prepared by the following steps:

A thermosensitive-coloring-layer-formation liquid comprising a leuco dye, an acidic material, a binder agent, a thermosensitivity-increasing agent and a filler is coated on a sheet-formed support material made of, for example, ordinary paper or synthetic paper, and is then dried, so that a thermosensitive coloring layer is formed on the support material. A protective-layer-formation liquid, comprising polyvinyl alcohol and, if necessary, with addition thereto of a thermosetting organic filler, an organic antifriction agent and a water resistant agent, is coated on the thermosensitive coloring layer and is then dried.

As mentioned above, the thermosensitive coloring layer in the present invention comprises a leuco dye, an acidic material, a binder agent and other components. Specific examples of these components for the formation of the thermosensitive coloring layer are as follows:

(1) Leuco Dyes

In the present invention, colorless or light-colored leuco dyes are usually employed. In particular, the following triphenylmethane leuco dyes, fluoran leuco dyes, phenothiazine leuco dyes, Auramine leuco dyes and spiropyran dyes are preferable for use in the present invention:

3,3-bis(p-dimethylaminophenyl)-6-dimethylaminophthalide;
3,3-bis(p-dimethylaminophenyl) phthalide;
3,3-bis(p-dimethylaminophenyl)-6-diethylaminophthalide;
3,3-bis(p-dimethylaminophenyl)-6-chlorophthalide;
3-(N-p-tolyl-N-ethylamino)-6-methyl-7-(N-phenylamino) fluoran;
3-diethylamino-7-chlorofluoran; benzoyl leuco methylene blue;
6'-chloro-8'-methoxy-benzoindolino-pyrylospiran;
6'-bromo-8'-methoxy-benzoindolino-pyrylospiran; and
2- [3,6-bis(diethylamino)-9-(o-chloroanilino) xanthyl] benzoic acid lactam.

(2) Acidic Materials

The following acidic materials, which react with the above-described leuco dyes by application of heat and color those leuco dyes, are employed:

a. Organic and Inorganic Acids:

Boric acid, oxalic acid, maleic acid, tartaric acid, citric acid, succinic acid, benzoic acid, stearic acid, gallic acid, salicylic acid, 1-hydroxy-2-naphthoic acid, o-hydroxy-benzoic acid, m-hydroxybenzoic acid, and 2-hydroxy-p-toluic acid.

b. Phenolic Materials:

3,5-xylenol, thymol, p-tert-butylphenol, 4-hydroxyphenoxide, methyl-4-hydroxybenzoate, 4-hydroxyacetophenone, $\alpha$-naphthol, $\beta$-napthol, catechol, resorcin, hydroquinone, 4-tertoctylcatechol, 2,2'-dihydroxydiphenol, 2,2'-methylene-bis(4-methyl-6-tert-butylphenol), 2,2-bis(4-hydroxyphenyl) propane (or bisphenol A), 4,4-isopropylidene-bis (2-tert-butylphenol), 4,4-sec-butylidene-diphenol, pyrogallol, phloroglucine and phlorogluocino-carboxylic acid.

(3) Binder Agents

Binder agents for use in the present invention serve to bind the thermosensitive coloring layer to the support material. Examples of such binder agents are as follows:

Water-soluble organic polymers, such as polyvinyl alcohol, methoxy cellulose, hydroxyethyl cellulose, carboxymethyl cellulose, polyvinyl pyrrolidone, polyacrylamide, polyacrylic acid, starch and gelatin; and aqueous emulsions of polystyrene, a copolymer of vinyl chloride and vinyl acetate, and polybutylmethacrylate.

In the thermosensitive coloring layer, the following additives can be contained in the form of fine powder, which are useful in obtaining clear images:

Calcium carbonate, silica, alumina, magnesia, talc, titania, barium sulfate and aluminum stearate.

Further, to the thermosensitive coloring layer, a thermosensitivity-increasing agent, for instance, higher fatty acid amides, can be added.

The thermosensitive recording material according to the present invention is suitable for use as thermosensitive-recording-type tickets, including magnetic tickets, such as coupon tickets, passenger tickets, commutation tickets, and as thermosensitive-recording-type labels for indicating numbers, prices, product names, etc.

When the thermosensitive recording material according to the present invention is employed in the form of a magnetic ticket, a magnetic recording layer is formed on the back side of the thermosensitive recording material, opposite to the thermosensitive coloring layer thereof. In this case, a ferromagnetic substance such as $\gamma$-iron oxide is contained in the magnetic recording layer. As a binder agent for binding the ferromagnetic substance to the support material, in addition to the previously mentioned water-soluble binder agents, adhesive synthetic resins, such as polyvinyl chloride resin and polyurethane resin, can be employed.

When the thermosensitive recording material according to the present invention is employed in the form of a label sheet, an adhesive layer is formed on the back side of the support material of the thermosensitive recording material by a conventional procedure, and a disposable backing sheet is further attached to the adhesive layer, so that when the label sheet is used, the disposable backing sheet is peeled off the adhesive layer. In this case, between the back side of the support material and the adhesive layer of the thermosensitive recording material, there can be formed a barrier layer for preventing intrusion of plasticizers into the thermosensitive coloring layer through the adhesive layer and the support material when the label sheet is stuck on a plastic film, for instance, on a wrapping film.

This barrier layer can be formed in the same manner as in the case of the previously described protective layer. However, in the case of the barrier layer, the use of a polyvinyl alcohol with a saponification ratio of 70% to 85% is not an indispensable requirement, and the following water-soluble polymers can also be employed:

Polyvinyl alcohol, hydroxyethyl cellulose, methyl cellulose, carboxymethyl cellulose, starch and derivatives thereof, casein, sodium alginate, polyvinyl pyrrolidone, polyacrylamide, and a copolymer of styrene and maleic acid.

Embodiments of a thermosensitive recording material according to the present invention will now be described in detail.

EXAMPLE 1

A dispersion A, which is a magnetic coating liquid, was prepared by dispersing the following components in a ball mill for 48 hours.

| Dispersion A | (Parts by Weight) |
|---|---|
| Magnetic powder ($\gamma$-$Fe_2O_3$) | 100 |

-continued

| Dispersion A | (Parts by Weight) |
|---|---|
| Lecithin | 2 |
| Polyvinyl chloride resin | 15 |
| Polyurethane resin | 10 |
| Toluene | 120 |
| MIBK (methylisobutyl ketone) | 100 |

A dispersion A was coated uniformly on a sheet of commercially available high quality paper (basis weight: 157 g/m$^2$) so as to form a magnetic recording layer with a deposition of 40 g/m$^2$ of solid components thereof when the coated magnetic recording layer was dried.

A dispersion B and a dispersion C were prepared separately by dispersing the following components of each dispersion in an attritor for 12 hours.

| Dispersion B | (Parts by Weight) |
|---|---|
| 3-diethylamino-6-methyl-7-anilinofluoran | 1.5 |
| Calcium carbonate | 1.0 |
| 20% aqueous solution of oxidized starch | 5.0 |
| Water | 42.5 |

| Dispersion C | (Parts by Weight) |
|---|---|
| Bisphenol A | 6.0 |
| Stearamide | 1.0 |
| 20% aqueous solution of polyvinyl alcohol | 5.0 |
| Water | 38.0 |

The thus prepared dispersion B and dispersion C were mixed together well to prepare a thermosensitive coloring liquid for forming a thermosensitive coloring layer. The thermosensitive coloring liquid was coated uniformly on the side of the paper opposite to the side having the magnetic recording layer coated thereon so as to form a thermosensitive coloring layer with a deposition of 8 g/m$^2$ of solid components thereof when the thermosensitive coloring layer was dried.

A dispersion D was prepared by mixing the following components to prepare a protective layer formation liquid:

| Dispersion D | (Parts by Weight) |
|---|---|
| Polyvinyl alcohol with a saponification ratio of 80% | 5.0 |
| Water | 95.0 |

The thus prepared protective layer formation liquid was coated uniformly on the thermosensitive coloring layer so as to form a protective layer with a deposition of 2 g/m$^2$ of solid components thereof when the protective layer was dried.

The thus prepared thermosensitive recording material was subjected to calendering to make its surface smooth, and magnetic ticket batch No. 1 was made therefrom.

COMPARATIVE EXAMPLE 1-1

Example 1 was repeated except that the dispersion D was replaced by a dispersion E which was prepared by mixing the following components, so that comparative magnetic ticket batch No. C1-1 was prepared.

| Dispersion E | (Parts by Weight) |
|---|---|
| Polyvinyl alcohol with a saponification ratio of 95% | 5.0 |
| Water | 95.0 |

COMPARATIVE EXAMPLE 1-2

Example 1 was repeated except that the dispersion D was replaced by a dispersion F which was prepared by mixing the following components, so that comparative magnetic ticket batch No. C1-2 was prepared.

| Dispersion F | (Parts by Weight) |
|---|---|
| Oxidized starch | 5.0 |
| Water | 95.0 |

COMPARATIVE EXAMPLE 1-3

Example 1 was repeated except that the dispersion D was replaced by a dispersion G which was prepared by mixing the following components, so that comparative magnetic ticket batch No. C1-3 was prepared.

| Dispersion G | (Parts by Weight) |
|---|---|
| Hydroxyethyl cellulose | 5.0 |
| Water | 95.0 |

By use of a ticket vending machine provided with a thin film thermal head (with a head voltage of 12 V), thermal printing was done on the magnetic tickets No. 1 according to the present invention and on the comparative magnetic tickets No. C1-1 through No. C1-3.

The thermally-printed-image-bearing tickets were stored in a commutation-ticket holder made of soft polyvinyl chloride resin and in a purse made of leather for 3 months in order to investigate to what extent the thermally printed images on each magnetic ticket were erased by the plasticizers contained in the ticket holder and purse.

The results are shown in Table 1 as follows:

TABLE 1

| | Initial | Image Density after 3-Month Storage | |
|---|---|---|---|
| | Image Density | PCT Ticket Holder | Leather Purse |
| No. 1 | 1.21 | 1.15 | 1.13 |
| No. C1-1 | 1.20 | 1.00 | 1.00 |
| No. C1-2 | 1.22 | 0.80 | 0.82 |
| No. C1-3 | 1.23 | 0.65 | 0.60 |

As can be seen from the above table, the thermally printed images on the magnetic tickets made of the thermosensitive recording material according to the present invention were not appreciably erased by plasticizers, and are of a permanence suitable for use in practice.

EXAMPLE 2-1

A dispersion H and a dispersion I were prepared separately by mixing the following components of each dispersion in a ball mill for 24 hours.

| Dispersion H | (Parts by Weight) |
|---|---|
| 3-diethylamino-6-methyl-7-anilinofluoran | 1.5 |
| Calcium carbonate | 1.0 |
| 20% aqueous solution of oxidized starch | 5.0 |
| Water | 42.5 |

| Dispersion I | (Parts by Weight) |
|---|---|
| Bisphenol A | 6.0 |
| 20% aqueous solution of polyvinyl alcohol | 8.0 |
| Water | 36.0 |

The thus prepared dispersion H and dispersion I were mixed together well to prepare a thermosensitive coloring liquid for forming a thermosensitive coloring layer. The thermosensitive coloring liquid was coated uniformly on a sheet of high quality paper of the same type as that employed in Example 1, so as to form a thermosensitive coloring layer with a deposition of 8 g/m$^2$ of solid components thereof when the thermosensitive coloring layer was dried.

A 5% aqueous solution of polyvinyl alcohol with a saponification ratio of 70% was coated uniformly on the thermosensitive coloring layer so as to form a protective layer with a deposition of 2 g/m$^2$ of solid components thereof when the protective layer was dried, whereby a thermosensitive-recording-type label sheet No. 2-1 according to the present invention was prepared.

EXAMPLE 2-2

Example 2-1 was repeated except that the polyvinyl alcohol with a saponification ratio of 70% was replaced by polyvinyl alcohol with a saponification ratio of 85%, so that a thermosensitive-recording-type label sheet No. 2-2 was prepared.

EXAMPLE 2-3

Example 2-1 was repeated except that the aqueous solution of polyvinyl alcohol with a saponification ratio of 70% was replaced by a solution prepared by mixing 40 parts by weight of a 5% aqueous solution of a polyvinyl alcohol with a saponification ratio of 80% and 1 part by weight of calcium carbonate, so that a thermosensitive-recording-type label sheet No. 2-3 was prepared.

COMPARATIVE EXAMPLE 2-1

Example 2-1 was repeated but without coating with the aqueous solution of polyvinyl alcohol with a saponification ratio of 70%, so that a comparative thermosensitive-recording-type label sheet No. C2-1 was prepared.

COMPARATIVE EXAMPLE 2-2

Example 2-1 was repeated except that the aqueous solution of polyvinyl alcohol with a saponification ratio of 70% was replaced by a 5% aqueous solution of oxidized starch, so that a comparative thermosensitive-recording-type label sheet No. C2-2 was prepared.

COMPARATIVE EXAMPLE 2-3

Example 2-1 was repeated except that the aqueous solution of polyvinyl alcohol with a saponification ratio of 70% was replaced by a 5% aqueous solution of polyvinyl alcohol with a saponification ratio of 99%, so that a comparative thermosensitive-recording-type label sheet No. C2-3 was prepared.

Thermal printing was performed on the thus prepared thermosensitive-recording-type labels by use of a heat gradient test apparatus (made by Toyo Seiki Co., Ltd.) at 150° C. with a pressure of 2 kg/cm$^2$ applied to each label for 1 second. The printed portions of each label were covered with a polyvinyl chloride wrap film (Trade Name: Polymerwrapy U-300 made by Shin-etsu Polymer Company, Ltd.). Each label was allowed to stand at 20° C. with a pressure of 100 g/cm$^2$ applied thereto for 24 hours.

Changes in image density of the printed images in each label were measured by a Macbeth densitometer.

The results of the measurements are shown in Table 2.

TABLE 2

| | Initial Image Density | Image density After 24 Hours |
|---|---|---|
| No. 2-1 | 1.32 | 1.32 |
| No. 2-2 | 1.32 | 1.32 |
| No. 2-3 | 1.32 | 1.30 |
| No. C2-1 | 1.33 | 0.32 |
| No. C2-2 | 1.32 | 0.71 |
| No. C2-3 | 1.31 | 0.93 |

As can be seen from the above results, the coloring performance of the thermosensitive-recording-type label sheets according to the present invention was not deteriorated by heat application and, at the same time, the thermosensitive coloring layers were protected from the plasticizer contained in the polyvinyl chloride wrap film employed in the above-described test.

Furthermore, the protective layers formed in the label sheets according to the present invention were superior in protective performance to the protective layers employed in the comparative label sheets.

In the examples No. 2-1 through No. 2-3, no adhesive layer was formed. In cases wherein an adhesive layer was formed in the conventional manner as described previously, the same results as described above were obtained with respect to the examples according to the present invention.

EXAMPLE 3

Example 1 was repeated except that the deposited amount of the protective layer was 0.4 g/m$^2$ based on the solid components thereof, when the protective layer was dried, whereby a magnetic ticket batch No. 3 according to the present invention was prepared. The thickness of the protective layer was about 0.4 $\mu$m.

EXAMPLE 4

Example 1 was repeated except that the deposited amount of the protective layer was 15 g/m$^2$, based on the solid components thereof, when the protective layer was dried, whereby a magnetic ticket batch No. 4 according to the present invention was prepared. The thickness of the protective layer was about 15 $\mu$m.

EXAMPLE 5

Example 1 was repeated except that the deposited amount of the protective layer was 25 g/m$^2$, based on the solid components thereof, when the protective layer was dried, whereby a magnetic ticket batch No. 5 according to the present invention was prepared. The thickness of the protective layer was about 25 μm.

COMPARATIVE EXAMPLE 3

Example 1 was repeated except that the dispersion D was replaced by the dispersion E which was prepared as described in Comparative Example 1-1, and a protective layer was formed at a deposition rate of 0.4 g/m$^2$, based on the solid components thereof when the protective layer was dried, whereby a comparative magnetic ticket batch No. 3 was prepared. The thickness of the protective layer was about 0.4 μm.

COMPARATIVE EXAMPLE 4

Example 1 was repeated except that the dispersion D was replaced by the dispersion E which was prepared as described in Comparative Example 1-1, and a protective layer was formed at a deposition rate of 15 g/m$^2$, based on the solid components thereof when the protective layer was dried, whereby a comparative magnetic ticket batch No. 5 was prepared. The thickness of the protective layer was about 15 μm.

COMPARATIVE EXAMPLE 5

Example 1 was repeated except that the dispersion D was replaced by the dispersion E which was prepared as described in Comparative Example 1-1, and a protective layer was formed at a deposition rate of 25 g/m$^2$, based on the solid components thereof when the protective layer was dried, whereby a comparative magnetic ticket batch No. 6 was prepared. The thickness of the protective layer was about 25 μm.

By use of a ticket vending machine provided with a thin film thermal head (with a head voltage of 12 V), thermal printing was done on the magnetic tickets No. 3, No. 1, No. 4 and No. 5 according to the present invention and on the comparative magnetic tickets No. 3, No. C1-1, No. 4 and No. 5.

The thermally-printed-image-bearing tickets were stored in a commutation-ticket holder made of soft polyvinyl chloride resin for 3 months in order to investigate to what extent the thermally printed images on each magnetic ticket were erased by the plasticizers contained in the ticket holder.

The results are shown in Table 3 as follows:

TABLE 3

| | Thickness of Protective Layer | Initial Image Density | Image Density after 3-month Storage in PVC Ticket Holder |
|---|---|---|---|
| Example 3 | 0.4 μm | 1.28 | 1.13 |
| Comparative Example 3 | | 1.28 | 0.92 |
| Example 1 | 2.0 μm | 1.21 | 1.15 |
| Comparative Example C1-1 | | 1.20 | 1.00 |
| Example 4 | 15.0 μm | 1.18 | 1.17 |
| Comparative Example 4 | | 1.18 | 1.10 |
| Example 5 | 25.0 μm | 1.15 | 1.15 |
| Comparative Example 5 | | 1.15 | 1.15 |

The above results indicate when the saponification ratio of the polyvinyl alcohol contained in the protective layer was 80%, the thermosensitive coloring layer was protected sufficiently from the adverse effects of the plasticizers, and the image density after three-month storage in the PVC ticket holder was as high as 1.13 in Example 3 even if the protective layer was as thin as 0.4 μm, whereas when the saponification ratio of the polyvinyl alcohol was 95%, the thermosensitive coloring layer was not protected from the plasticizers and the image density after 3-month storage in the PVC ticket holder was reduced to 0.92, for instance, in Comparative Example 3.

The same thing also applies to Examples 1 and 4, and Comparative Examples C1-1 and 4. However, when the protective layer was as thick as 25 μm, there were no difference in the initial image density and the image density after 3-month storage in the PVC ticket holder between Example 5 and Comparative Example 5. In these examples, each thermosensitive coloring layer was protected by the thick protective layer, so that the initial image density and the image density after 3-month storage in the PVC ticket holder were the same. However, the initial image density which corresponded to the thermal response was low.

Generally, when the deposition of the solid components of the protective layer is 1 g/m$^2$ when dried, the thickness of the protective layer is about 1 μm, when the deposition of the solid components of the protective layer is 2 g/m$^2$, the thickness of the protective layer is about 2 μm, and when the deposition of the solid components of the protective layer is 3 g/m$^2$, the thickness of the layer is about 3 μm.

What is claimed is:

1. A thermosensitive recording material comprising, in successive layers:

a support material;

a thermosensitive coloring layer formed on the front side of said support material, said thermosensitive coloring layer comprising a leuco dye and an acidic material, said acidic material being capable of causing said leuco dye to become colored when heat is applied thereto; and a protective layer formed on the front side of said thermosensitive coloring layer, said protective layer comprising polyvinyl alcohol having a saponification ratio in the range of from 70% to 85%.

2. A thermosensitive recording material as claimed in claim 1, further comprising a magnetic recording layer formed on the back side of said support material, opposite to said thermosensitive coloring layer.

3. A thermosensitive recording material as claimed in claim 2, wherein said magnetic recording layer comprises a ferromagnetic substance and a binder agent for binding said ferromagnetic substance to said support material.

4. A thermosensitive recording material as claimed in claim 1, further comprising an adhesive layer formed on the back side of said support material, opposite to said thermosensitive coloring layer, said adhesive layer being suitable for adhesively securing said recording material to a surface.

5. A thermosensitive recording material as claimed in claim 4, further comprising a barrier layer between the back side of said support material and said adhesive layer, said barrier layer comprising a polymeric material capable of inhibiting penetration of materials capable of discoloring said thermosensitive coloring layer.

6. A thermosensitive recording material as claimed in claim 4, further comprising a disposable backing sheet which is attached to said adhesive layer and can be peeled off said adhesive layer when said thermosensitive recording material is used.

7. A thermosensitive recording material as claimed in claim 1, wherein said protective layer further comprises at least one member selected from the group consisting of a thermosetting organic filler, an organic antifriction agent and a water resistant agent.

8. A thermosensitive recording material as claimed in claim 7, said thermosetting organic filler is a member selected from the group consisting of urea-formaldehyde resin, phenolic resin, polycarbonate resin and malamine resin.

9. A thermosensitive recording material as claimed in claim 8, wherein the amount of said thermosetting organic filler in said protective layer is in the range of 5 to 40 weight percent with respect to the total weight of said protective layer.

10. A thermosensitive recording material as claimed in claim 7, wherein said organic antifriction agent is a member selected from the group consisting of animal waxes, vegetable waxes, petroleum waxes and synthetic waxes other than petroleum waxes.

11. A thermosensitive recording material as claimed in claim 10, wherein the amount of said organic antifriction agent in said protective layer is in the range of 20 to 60 weight percent with respect to the total weight of said protective layer.

12. A thermosensitive recording material as claimed in claim 1, wherein said leuco dye is a member selected from the group consisting of triphenylmethane leuco dyes, fluoran leuco dyes, phenothiazine leuco dyes, Auramine leuco dyes and spiropyran leuco dyes.

13. A thermosensitive recording material as claimed in claim 1, wherein said acidic material is a member selected from the group consisting of organic acids, inorganic acids and phenolic materials.

14. A thermosensitive recording material as claimed in claim 1, wherein said thermosensitive coloring layer further comprises a binder agent containing a water-soluble organic polymer.

15. In a thermosensitive recording material comprising a support and a thermosensitive coloring layer formed on the front side of said support, said thermosensitive coloring layer containing a leuco dye and an acidic material capable of coloring said leuco dye when heat is applied thereto, the improvement which comprises:

a protective layer formed on and covering the front side of said thermosensitive coloring layer for protecting said thermosensitive coloring layer against the action of plasticizers contained in plastic films that contact said recording material, said protective layer comprising polyvinyl alcohol resin having a saponification ratio in the range of from 70% to 85%, said protective layer being thin so that it does not hinder coloring of said thermosensitive coloring layer when heat is applied to said protective layer to effect coloring of said coloring layer.

* * * * *